US008081893B2

(12) United States Patent
Sato

(10) Patent No.: US 8,081,893 B2
(45) Date of Patent: Dec. 20, 2011

(54) ELECTROPHOTOGRAPHIC IMAGE FORMING APPARATUS WITH IMPROVED TEMPERATURE CONTROL

(75) Inventor: Toshiki Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 626 days.

(21) Appl. No.: 12/210,943

(22) Filed: Sep. 15, 2008

(65) Prior Publication Data

US 2009/0074441 A1 Mar. 19, 2009

(30) Foreign Application Priority Data

Sep. 14, 2007 (JP) ..... 2007-239280

(51) Int. Cl.
*G03G 15/20* (2006.01)

(52) U.S. Cl. ..... 399/69

(58) Field of Classification Search ..... 399/68, 399/69, 329
See application file for complete search history.

(56) References Cited

U.S. PATENT DOCUMENTS 7,664,449 B2 * 2/2010 Kimura ..... 399/329
7,890,041 B2 * 2/2011 Kobayashi ..... 399/329

FOREIGN PATENT DOCUMENTS

JP 2005-134646 5/2005

* cited by examiner

*Primary Examiner* — William J Royer
(74) *Attorney, Agent, or Firm* — Rabin & Berdo, P.C.

(57) ABSTRACT

An image forming apparatus is provided that has a first pressurizing member, a heating member, and a belt member laid across the heating member and the first pressurizing member in a tensioned state, the belt member being heated by the heating member. The apparatus also includes a second pressurizing member arranged at such position that the second pressurizing member is pressed against the first pressurizing member via the belt member, a fixing unit for fixing a developer image on a medium between the belt member and the second pressurizing member, and a heating control unit for controlling heating of the heating member to drive a temperature of the heating member toward a predetermined target temperature. In addition, the apparatus includes a first temperature detection unit for detecting the temperature of the first pressurizing member. The heating control unit determines the targeted temperature based on the temperature of the first pressurizing member detected by the first temperature detection unit.

12 Claims, 14 Drawing Sheets

ELECTROPHOTOGRAPHIC IMAGE FORMING APPARATUS WITH IMPROVED TEMPERATURE CONTROL

BACKGROUND OF THE INVENTION

1. Field of the Invention

The present invention relates to an image forming apparatus equipped with a fixing device having a fixing belt.

2. Description of Related Art

A printing process of an electrophotographic printer is achieved with multiple steps. First, after a charging device charges a photosensitive drum, a writing light forms an electrostatic latent image on the photosensitive drum. A developing device attaches toner to the photosensitive drum, and thereby the electrostatic latent image is developed and becomes a visible image. Subsequently, the toner is transferred from the photosensitive drum to a sheet of paper with electrostatic attraction, and thereafter, a fixing device fixes the transferred toner onto the paper with heat and pressure.

In a conventional fixing device, for example as disclosed in Japanese Patent Application Publication No. 2005-134646, a fixing belt is laid across a heating roller and a fixing roller in a tensioned state, and the fixing belt is heated. A temperature detection means detects the temperature at a contacting portion between the fixing belt and the heating roller, and a heater is controlled so that the temperature at the contacting portion becomes constant. The toner transferred onto the paper is fixed thereon with heat and pressure while the sheet of paper is conveyed between the fixing belt and a pressure roller pressed against the fixing roller via the fixing belt.

However, the conventional fixing device as disclosed in Japanese Patent Application Publication No. 2005-134646 controls the surface temperature of the fixing belt contacting the heating roller so that the surface temperature becomes constant, but the heat energy held by the fixing belt is taken away because the fixing belt is in contact with the fixing roller at a contacting portion between a pressure roller and the sheet of paper (hereinafter referred to as a nip portion). Thus, there exists the problem that the heat energy given from the fixing roller to the sheet of paper varies, thus deteriorating the printing quality.

This invention is made in consideration of these circumstances, and it is the object of the present invention to provide an image forming apparatus controlling the temperature at the nip portion so that the temperature quickly becomes an ideal printing temperature and capable of starting printing in a shorter time even in a case where the temperature of the fixing roller is low.

SUMMARY OF THE INVENTION

To solve the above problems, an image forming apparatus of this invention has a first pressurizing member, a heating member, a belt member laid across the heating member and the first pressurizing member in a tensioned state, the belt member being heated by the heating member, a second pressurizing member arranged at such position that the second pressurizing member is pressed against the first pressurizing member via the belt member, a fixing unit for fixing a developer image on a medium between the belt member and the second pressurizing member, a heating control unit for controlling heating of the heating member to drive a temperature of the heating member toward a predetermined target temperature, and a first temperature detection unit for detecting a temperature of the first pressurizing member, wherein the heating control unit determines the target temperature based on the temperature of the first pressurizing member detected by the first temperature detection unit.

Thus, the image forming apparatus of this invention controls heating of the heating member according to the temperature of the first pressurizing member, thus capable of stably providing heat energy to the medium even where the temperature of the first pressurizing member changes. The image forming apparatus can prevent deterioration of the printing quality.

DETAILED DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

PREFERRED EMBODIMENTS

First Embodiment

Figure 1:
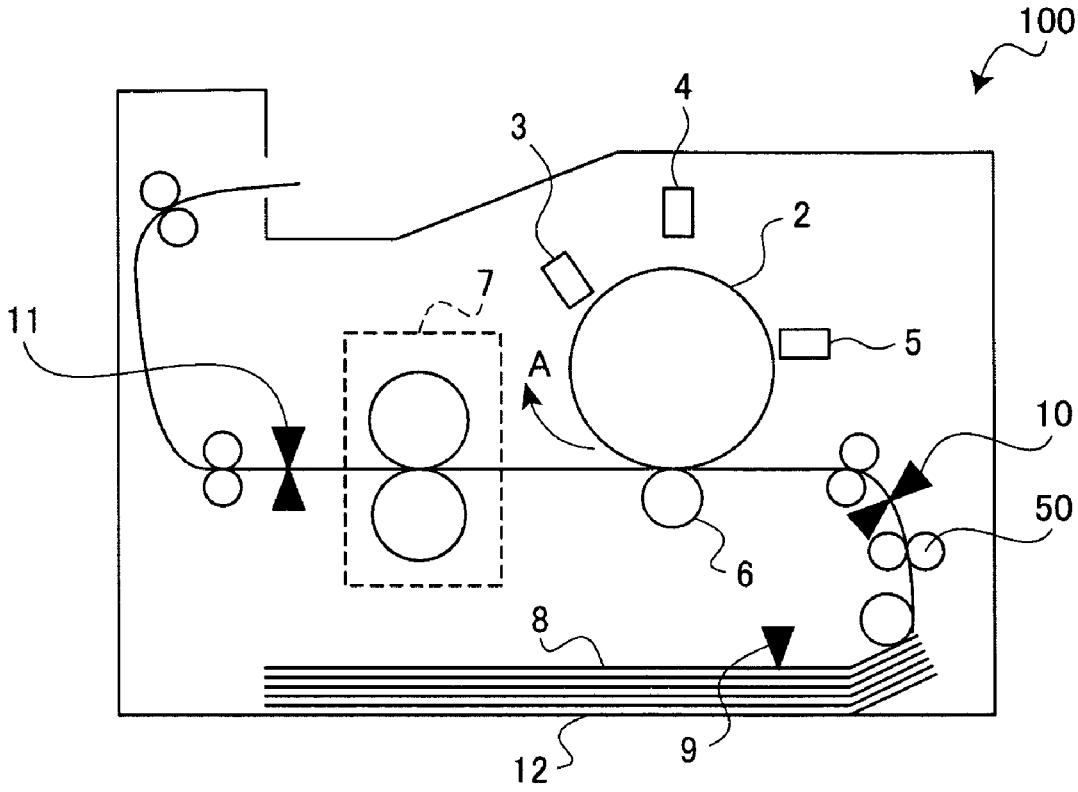
FIG. 1 is a figure describing the configuration of a printer 100 according to the first embodiment.

A printer according to the first embodiment of the present invention will be hereinafter described with reference to the figures. FIG. 1 is a figure describing the configuration of an essential portion of a printer 100 according to the first embodiment. The printer 100 has a photosensitive drum 2 rotating in the direction of an arrow A as an electrostatic latent image holder, a charging device 3 arranged in contact with the photosensitive drum 2 for uniformly charging the surface of the photosensitive drum 2, a light emitting diode (LED) head 4 forming an electrostatic latent image by emitting a recording light to the charged photosensitive drum 2, a developing device 5 arranged in contact with the photosensitive drum 2 attaching toner to the electrostatic latent image on the surface of the photosensitive drum 2, a transfer device 6 transferring the toner image formed with the electrostatic latent image having the toner attached thereto to a medium 8 with an electrostatic attraction force, a fixing device 7 fixing the transferred toner onto the medium 8, a paper remaining amount sensor 9 detecting whether the medium 8 exists, a writing sensor 10 detecting a starting time of the image formation, a discharge sensor 11 keeping track of a paper conveyance position of the medium 8, a paper cassette 12 holding the medium 8, and a conveyance roller 50 as a conveyance mechanism of the medium 8.

Figure 2:
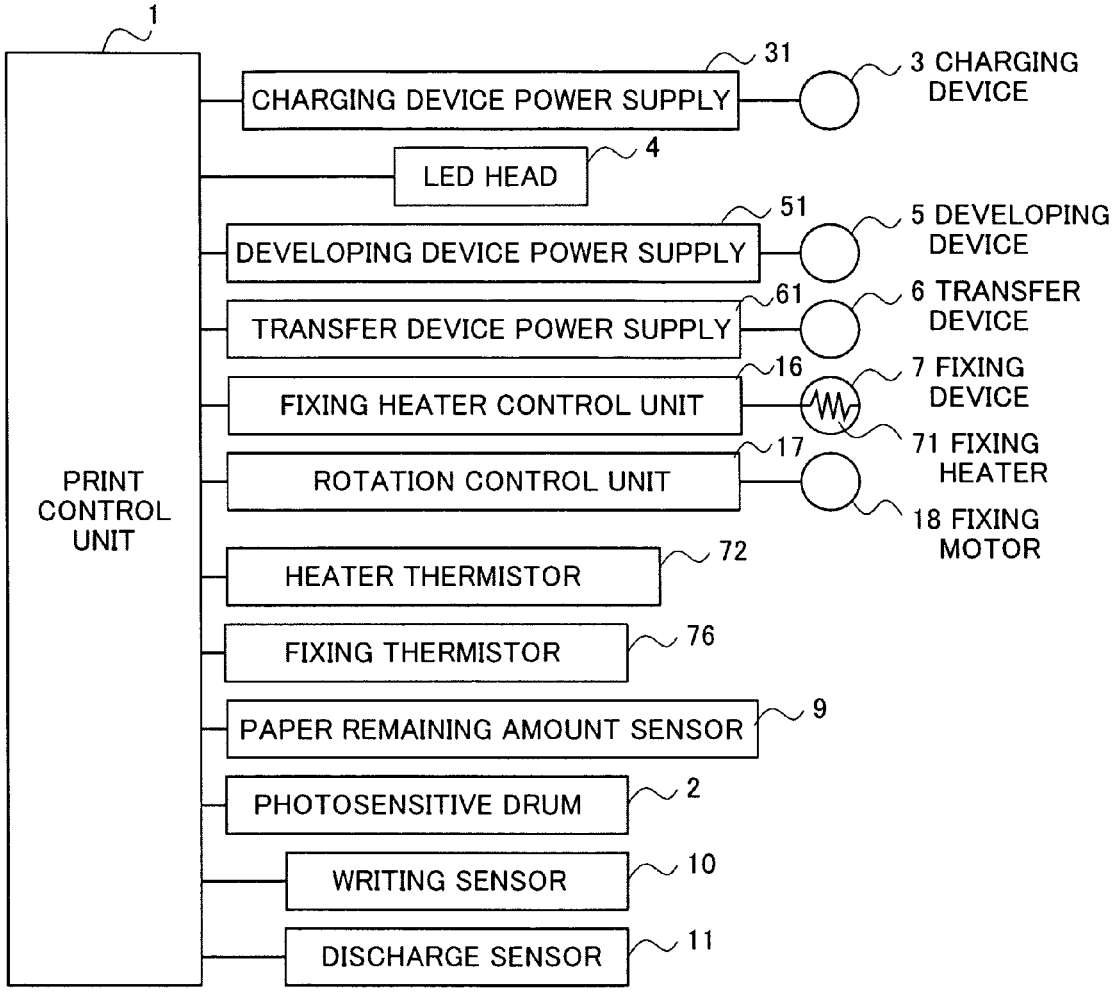
FIG. 2 is a figure describing the configuration of an essential portion of the printer 100 controlled by a print control unit 1.

FIG. 2 is a block diagram describing the configuration of an essential portion controlled by a print control unit 1 of the printer 100 according to the first embodiment. The print control unit 1 is a control unit having a microprocessor, a Read-Only Memory (ROM), an electronically erasable and programmable ROM (EEPROM), a random Access Memory (RAM), an input and output port, a timer, and the like. The print control unit 1 is connected to an external information processing apparatus such as a personal computer and the like. The print control unit 1 performs printing operation according to a control signal from a host controller and the like controlling the entire operation of the printer 100, a video signal consisting of data including bit map data arranged one-dimensionally and the like.

The print control unit 1 is connected with the photosensitive drum 2, the LED head 4, the paper remaining amount sensor 9, the writing sensor 10, the discharge sensor 11, a fixing heater control unit 16, a rotation control unit 17, a charging device power supply 31, a developing device power supply 51, a transfer device power supply 61, a heater temperature detection sensor (hereinafter referred to as a thermistor heater) 72, and a fixing roller temperature detection sensor (hereinafter referred to as a fixing thermistor) 76 as a temperature detection means.

The charging device power supply 31 is connected with the charging device 3. The charging device power supply 31 applies a voltage to the charging device 3 based on an instruction of the print control unit 1. For example, the charging device power supply 31 charges the photosensitive drum 2 to −600V by applying the voltage to the charging device 3. The developing device 5 is connected to the developing device power supply 51. The developing device power supply 51 applies a voltage to the developing device 5 based on an instruction of the print control unit 1 to charge the toner to a negative potential. As a result, the toner is attached to the electrostatic latent image formed by the LED head 4 on the photosensitive drum 2 and a toner image is formed as a visible image. The transfer device 6 is connected to the transfer device power supply 61. The transfer device power supply 61 applies a voltage to the transfer device 6 based on an instruction of the print control unit 1. The transfer device power supply 61 applies, for example, a voltage of +2000V to +3000V to the transfer device 6 to transfer the toner image formed on the photosensitive drum 2 onto the medium 8 with the electrostatic attracting force. The fixing heater control unit 16 as a heating control means is connected to a fixing heater 71 as a heating member equipped with the fixing device 7. A fixing motor 18 is connected to the rotation control unit 17. The fixing heater control unit 16 and the rotation control unit 17 will be later described in detail.

Figure 3:
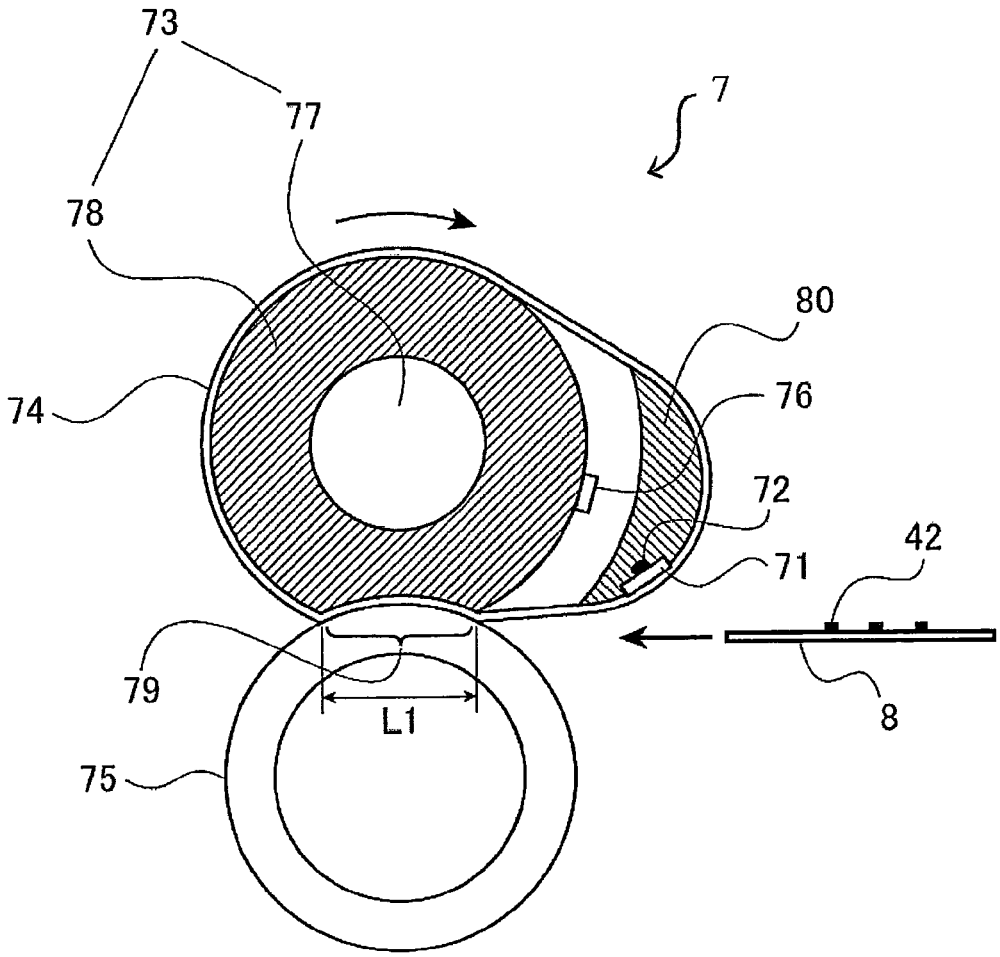
FIG. 3 is a figure describing the configuration of an essential portion of a fixing device.

FIG. 3 is a figure describing the configuration of an essential portion of the fixing device 7 according to this embodiment. The fixing device 7 has the fixing heater 71, the heater thermistor 72, a fixing roller 73 as a first pressurizing member, a fixing belt 74 as a belt member, a pressurizing roller 75 as a second pressurizing member, the fixing thermistor 76, and a guide 80.

As shown in FIG. 3, the endless fixing belt 74 for conveying the medium 8 is laid across the fixing roller 73 and the arc-shaped guide 80 in a tensioned state with a predetermined force. The pressurizing roller 75 is arranged at a position facing the fixing roller 73 via the fixing belt 74 to press against the fixing roller 73.

The heater thermistor 72 is arranged on the fixing heater 71 on a surface opposite to a surface in contact with the fixing belt 74. The fixing thermistor 76 is arranged on a periphery of the fixing roller 73 in an inner side of the fixing belt 74, and is arranged within a width of a printing area of the medium 8. In a case where the fixing thermistor 76 is arranged to be in contact with the outer periphery of the fixing belt 74, there is a possibility that the fixing thermistor 76 may damage the outer periphery of the fixing belt 74. Thus, the fixing thermistor 76 is arranged at the position shown in FIG. 3 to prevent deterioration of the printing quality.

The fixing roller 73 has an external diameter of 40 mm, and has a mandrel 77 as a base body consisting of a solid metal shaft made of steel, and an elastic layer 78 having a thickness of 4 mm and made of a heat-resistant porous sponge to coat the mandrel 77. The elastic layer 78 reduces the amount of heat energy removed from the fixing belt 74, reducing a temperature drop after an initial temperature rise, and shortens a pre-rotation time for recovering a temperature, because the material of the elastic layer 78 is a heat-resistant porous elastic member having a low thermal conductivity and a heat-insulation effect. The elastic layer 78 has a relatively low hardness, and a sufficient nip width L1 (the width of an area in which the medium 8 is pressed by the fixing belt 74 and is in contact therewith) can be obtained.

The fixing roller 73 has a gear, not shown, on an end portion thereof, and the gear is driven and rotated by a unit driving gear, not shown, to drive and rotate the fixing roller 73. The unit driving gear is driven and rotated by a main body driving gear, not shown, arranged on a side of the main body of the printer 100, and the main body driving gear is driven and rotated by the fixing motor 18, based on an instruction of the rotation control unit 17.

The fixing belt 74 has a structure that a releasing layer made of 200 μm silicone rubber is formed on a surface layer, i.e., a base body, made of a highly heat-resistant polyimide resin having a thickness of 100 μm. Thus, the fixing belt 74 has a small thermal capacity, and has a high thermal responsiveness. Alternatively, the base body may be made of rubber or metal such as stainless, nickel, and the like.

An urging member, not shown, such as a spring and the like urges the pressurizing roller 75 in a direction to come into a pressurized contact with the fixing roller 73. The pressurizing roller 75 is in contact with the fixing roller 73 at a position facing the fixing roller 73 via the fixing belt 74. Thus, a fixing nip portion 79 is formed as a nip between the pressurizing roller 75 and the fixing roller 73 contacting with each other via the fixing belt 74.

Figure 4:
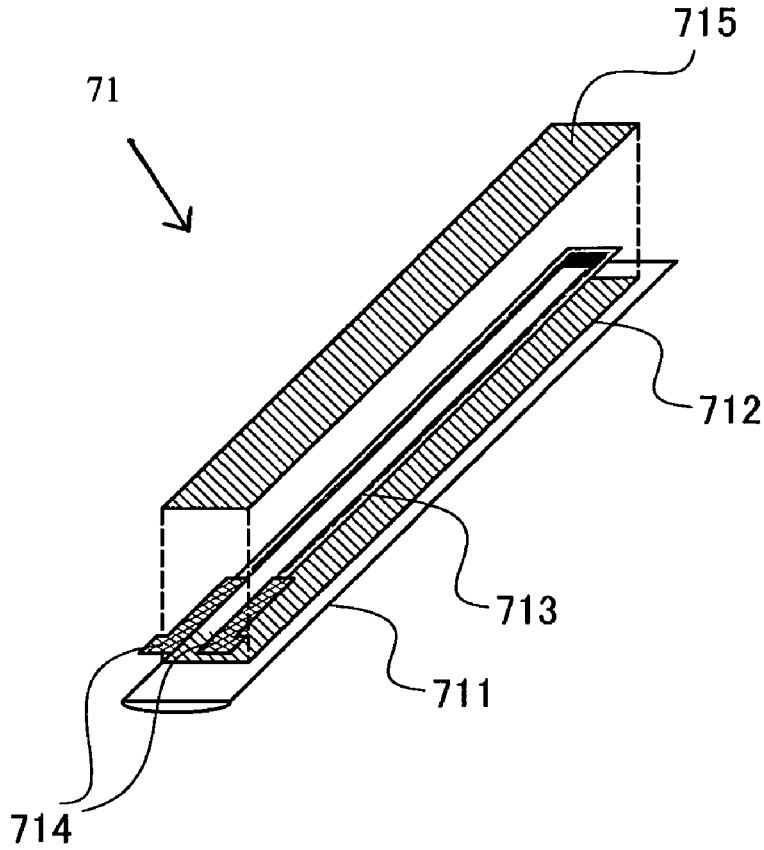
FIG. 4 is a figure describing the configuration of a fixing heater.

FIG. 4 is a figure describing the configuration of the fixing heater 71. For example, the fixing heater 71 is made by forming a glass film layer as an electric insulation layer 712 on a substrate 711 serving as the bottom layer such as SUS430, applying thereto a nickel-chrome alloy or silver-palladium alloy powder as a resistance heating body 713 with screen printing to make the powder into paste form, thereafter forming electrodes 714, at an end of the resistance heating body 713, made of a chemically stable metal having a low electric resistance such as silver and a high-melting point metal such as tungsten, and forming thereon a protection layer 715 made of glass or a fluorinated resin such as PTFE (polytetrafluoro-ethylene), PFA (tetrafluoroethylene Parfloroalkilbinilatel copolymer), and FEP(tetrafluoroethylene Hekisafloro propylene copolymer) to protect the layers. The fixing heater 71 is a sheet heater, and all over the surface of the protection layer 715 of the fixing heater 71 comes in contact with the inner surface of the fixing belt 74 to heat the fixing belt 74.

The electrodes 714 of the fixing heater 71 are connected to a power supply, not shown, as a voltage application means via the fixing heater control unit 16. The application of a voltage from this power supply heats the fixing heater 71. It is assumed for example that the applied voltage is 100V and the output is 600 W.

Operation of the printer 100 according to this embodiment will be hereinafter described. Upon detecting a print instruction from the host controller, the print control unit 1 gives an instruction to the rotation control unit 17 to rotate the fixing motor 18. The print control unit 1 gives an instruction to the heater thermistor 72 to detect the temperature of the fixing device 7 having the fixing heater 71, and makes a determination as to whether the temperature of the fixing device 7 detected by the heater thermistor 72 is within a temperature range in which printing can be performed. In a case where the temperature of the fixing device 7 has not yet reached the temperature at which the printing can be performed, the print control unit 1 gives an instruction to the fixing heater control unit 16 to turn on the fixing heater 71. The fixing heater control unit 16 receiving the turn-on instruction gives an instruction to a power supply, not shown, to apply a predetermined voltage to the fixing heater 71. The fixing heater 71 receiving the voltage heats itself, and applies heat to the fixing device 7 until the fixing device 7 reaches the temperature at which printing can be performed (warm-up period). At this moment, the print control unit 1 is monitoring the temperature detected by the heater thermistor 72, and then, the print control unit 1 starts the printing operation (printing period), after detecting that the fixing device 7 has reached the temperature at which printing can be performed.

The print control unit 1 supplies a detection instruction to the paper remaining amount sensor 9 to determine whether the medium 8 is set in the paper cassette 12. In a case where it is determined that the medium 8 used for printing is set in the paper cassette, the print control unit 1 rotates the conveyance roller 50 to convey the medium 8 into a print mechanism in the printer 100.

When the medium 8 reaches a position of the writing sensor 10 and the writing sensor 10 detects the medium 8, the print control unit 1 supplies an instruction to the charging device power supply 31 to apply a voltage to the charging device 3. The charging device 3 receiving the voltage charges the surface of the photosensitive drum 2 to a predetermined voltage.

Subsequently, the print control unit 1 converts a supplied video signal into a print data signal, and controls the LED head 4 to emit the recording light corresponding to the print data signal to the charged surface of the photosensitive drum 2. An electrostatic latent image corresponding to the print data signal is formed on the surface of the photosensitive drum 2 to which the recording light is emitted.

After the electrostatic latent image is formed on the surface of the photosensitive drum 2, the print control unit 1 gives an instruction to the developing device power supply 51 to apply a voltage to the developing device 5. The developing device 5 receiving the voltage causes a toner 42 to charge to a negative potential, and the charged toner 42 attaches to the electrostatic latent image on the surface of the photosensitive drum 2, so that a toner image is formed on the surface of the photosensitive drum 2. When the toner image formed on the surface of the photosensitive drum 2 is conveyed to a position facing the transfer device 6 as the photosensitive drum 2 rotates, the print control unit 1 gives an instruction to the transfer device power supply 61 to apply a voltage to the transfer device 6. In a transfer area formed between the photosensitive drum 2 and the transfer device 6 to which the voltage is applied, the electrostatic attracting force of the transfer device 6 causes the toner image formed on the photosensitive drum 2 to transfer to the medium 8.

When the medium 8 having the toner image transferred thereon is conveyed to the fixing device 7 including the fixing heater 71, the toner image is fixed to the medium 8 with heat and pressure of the fixing device 7. The medium 8 having the toner image transferred thereon is further conveyed and is discharged out of the printer 100 from the print mechanism of the printer 100. The discharge sensor 11 is arranged downstream of the fixing device 7 in a medium conveyance direction. When the medium 8 reaches the position of the discharge sensor 11, the discharge sensor 11 detects the position of the medium 8. When the discharge sensor 11 detects the medium 8, the print control unit 1 gives an instruction to the rotation control unit 17 to stop the fixing motor 18, and the fixing motor 18 stops its rotation to stop the printing operation.

Figure 5:
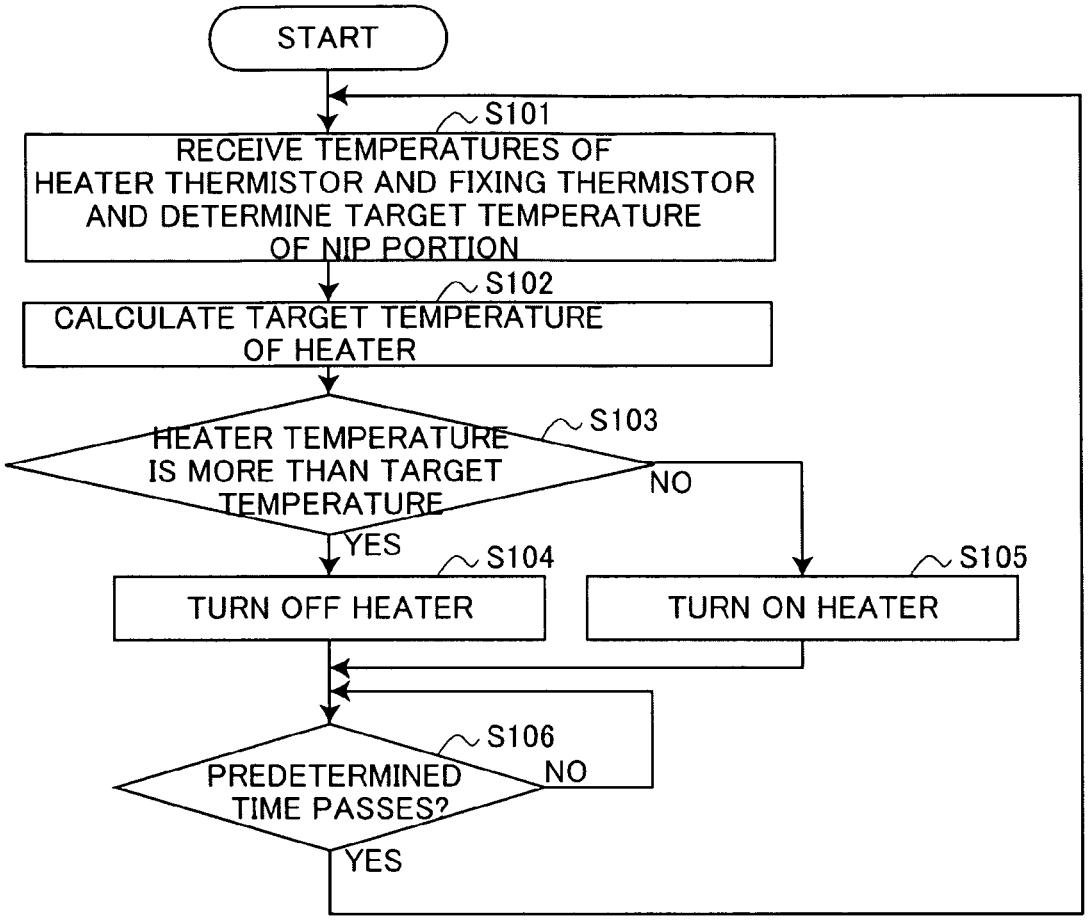
FIG. 5 is a flowchart describing a temperature control operation of the printer.

The temperature control operation according to this embodiment will be hereinafter described. FIG. 5 is a flowchart describing the temperature control operation of the printer 100. The print control unit 1 gives an instruction to detect the temperature of the fixing heater 71 with the heater thermistor 72 and to detect the temperature of the fixing roller 73 with the fixing thermistor 76, and receives the temperatures detected by the heater thermistor 72 and the fixing thermistor 76.

Next, the print control unit 1 uses the measured temperatures of each of the heater thermistor 72 and the fixing thermistor 76 to calculate a nip portion temperature using a below approximation formula (Formula 1) at the time of the measurement with the thermistor 72 and the fixing thermistor 76.

$$Tnip=A'*Theat(m)+B'*Troll(m)+C' \quad \text{(Formula 1)}$$

Tnip is the nip portion temperature, Theat(m) is the fixing heater temperature (a measured value), and Troll(m) is the fixing roller temperature (a measured value). A', B', C' are configuration values calculated from heat resistances of each member (calculated through experiment).

The print control unit 1 determines a target temperature of the nip portion based on a calculation result of the nip portion temperature (Tnip) calculated with Formula 1 and based on printing condition information supplied from the host controller (S101).

The print control unit 1 uses Formula 2 derived from Formula 1 to calculate (S102) a target temperature of the fixing heater 71 to make the nip portion temperature be the ideal temperature determined in S101.

$$Theat(s)=A*Tnip(t)-B*Troll(m)+C \quad \text{(Formula 2)}$$

Theat(s) is the target temperature of the fixing heater 71, and Thip(t) is the target temperature of the nip portion. A, B, and C are configuration values calculated from heat resistances of each member (calculated through experiment). The calculation method of the approximation formula and the calculation method of each configuration value will be described later.

The print control unit 1 compares (S103) the temperature of the fixing heater 71 measured by the heater thermistor 72 with the target temperature calculated in S102. In a case where the temperature of the fixing heater 71 is higher than the target temperature (S103 Y), the print control unit 1 gives an instruction to the fixing heater control unit 16 to stop the voltage application from the power supply, not shown, to the fixing heater 71 (S104). As a result, the heating of the fixing heater 71 stops, and the supply of the heat energy to the fixing belt 74 is blocked. Accordingly, the temperature of the fixing belt 74 decreases, and eventually, the nip portion temperature decreases. On the other hand, in a case where the temperature of the fixing heater 71 is lower than the target temperature (S103 N), the print control unit 1 gives an instruction to the fixing heater control unit 16 to start the voltage application from the power supply, not shown, to the fixing heater 71 (S105). As a result, the fixing heater begins to heat itself, the supply of the heat energy to the fixing belt 74 starts, the temperature of the fixing belt 74 increases, and eventually, the nip portion temperature increases.

The print control unit 1 causes the fixing heater control unit 16 to maintain a state of control of the fixing heater 71 until a predetermined time passes. After the predetermined time passes, the print control unit 1 goes back to S101 to start the same processing again (S106).

Figure 6A:
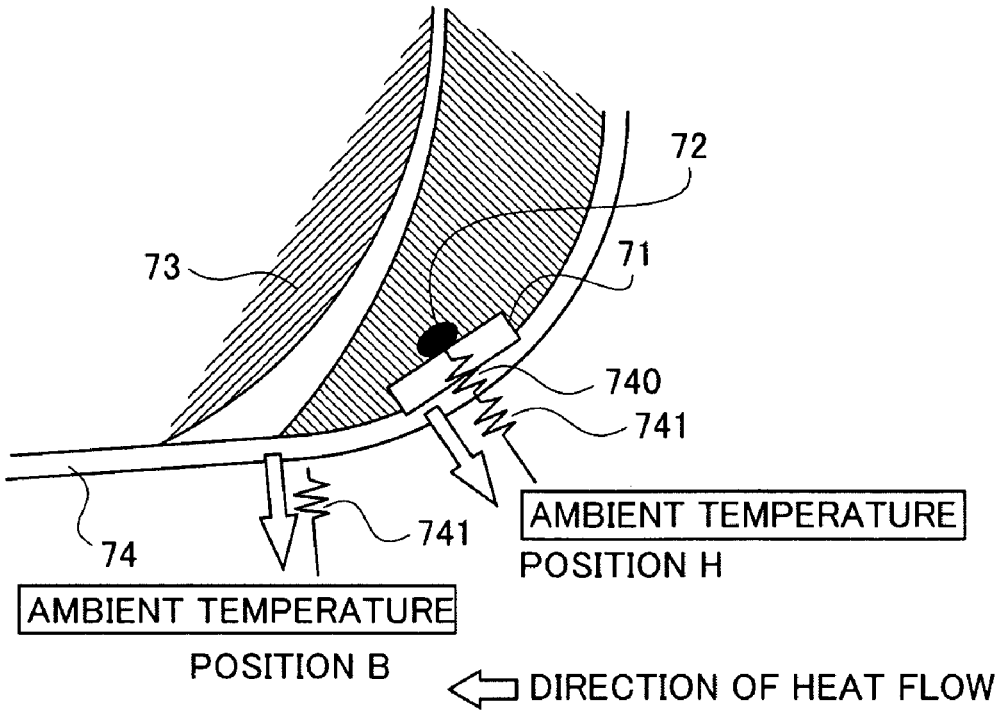
FIGS. 6A and 6B are figures describing a setting temperature calculation method of the fixing heater.
Figure 6B:
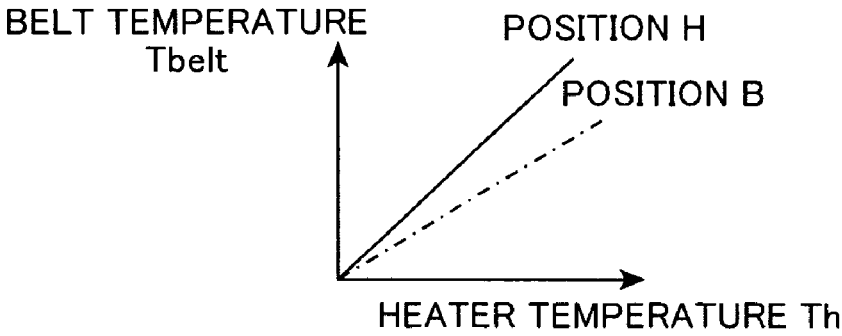
Figure 7A:
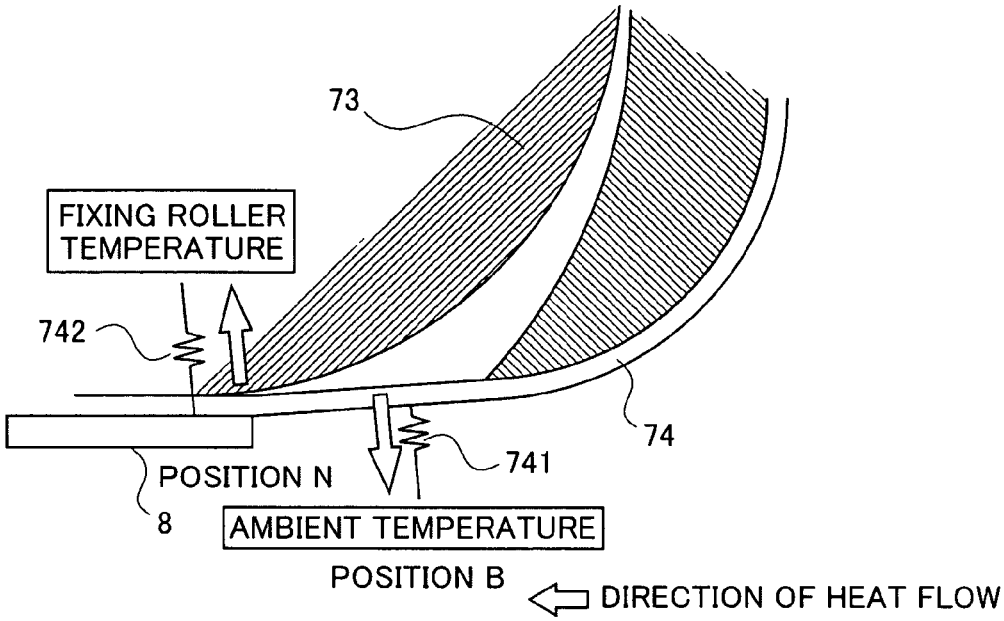
FIGS. 7A and 7B are figures describing the setting temperature calculation method of the fixing heater.
Figure 7B:
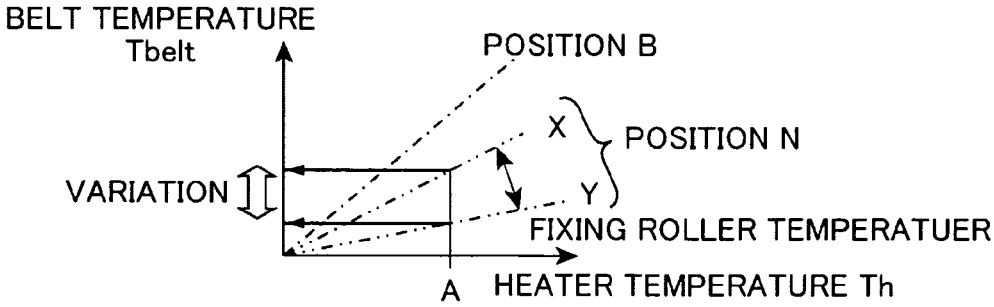
Figure 8:
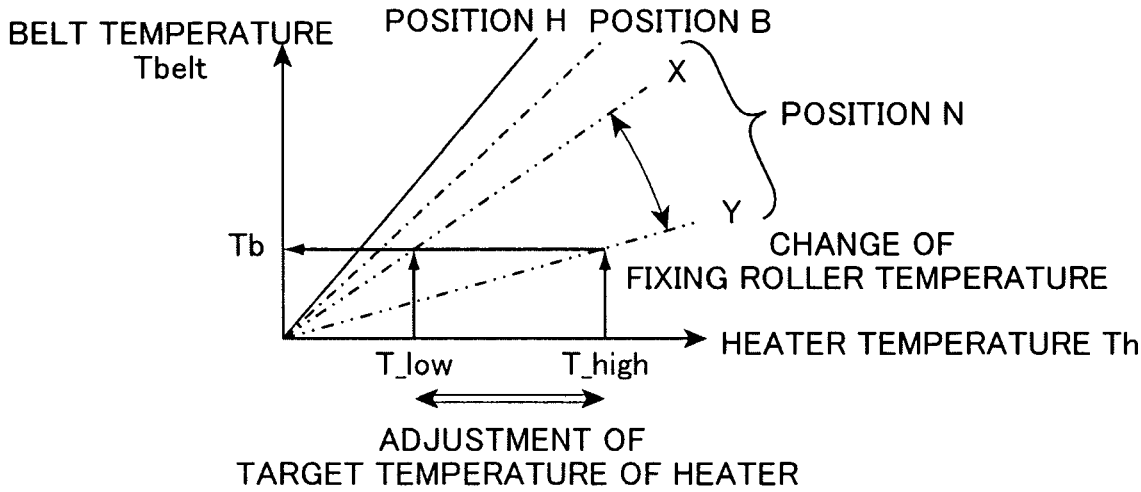
FIG. 8 is a figure describing the setting temperature calculation method of the fixing heater.

FIGS. 6 to 8 are figures describing the calculation method of the target temperature of the fixing heater 71 in this embodiment. FIG. 6A and FIG. 7A are schematic diagrams describing the relationship of thermal resistances between the fixing belt 74 and each member (the fixing heater 71 and the fixing roller 73). FIG. 6B and FIG. 7B are schematic diagrams describing the relationship between the temperature (Th) of the fixing heater 71 and the temperature (Tbelt) of the fixing belt 74 at two positions of the fixing belt 74 (relative positions with respect to the fixing heater 71 and the fixing roller 73) when the fixing roller 73 is rotated by the fixing 18.

FIG. 6B shows a relationship of temperatures between a position (position H) at which the fixing belt 74 is in contact with the fixing heater 71 and a position (position B) at which the fixing belt 74 is not in contact with the fixing heater 74 nor the fixing roller 73. As shown in FIG. 6A, in a thermal equivalent circuit at position H, the surface of the fixing belt 74 is connected to the fixing heater 71 and the ambient temperature via thermal resistors 740 and 741, respectively. The heat energy supplied from the fixing heater 71 increases the temperature of the fixing belt 74, and eventually, the heat energy is released to the ambient temperature from the surface of the fixing belt 74. Thus, a solid-line in FIG. 6B denotes the relationship between the temperature of the fixing heater 71 and the surface temperature of the fixing belt 74 at position H. When the fixing belt 74 moves to position B as the fixing roller 73 rotates, the supply of the heat energy from the fixing heater 71 to the fixing belt 74 is cut off, and the fixing belt 74 only releases the heat energy supplied at position H to the ambient temperature. Thus, the surface temperature of the fixing belt 74 decreases. A dashed dotted line in FIG. 6B denotes the relationship between the temperature of the fixing heater 71 and the surface temperature of the fixing belt 74 at position B.

FIG. 7B shows a relationship of temperatures between a position (position B) at which the fixing belt 74 is not in contact with the fixing heater 71 nor the fixing roller 73 and a position (position N) at which the fixing belt 74 is in contact with the fixing roller 73. As shown in FIG. 7A, in a thermal equivalent circuit, the surface of the fixing belt 74 is connected to the fixing roller 73 via the heat resistance 742 when the fixing belt 74 moves to a position (position N) at which the fixing belt 74 is in contact with the fixing roller 73. At this moment, in a case where the temperature of the fixing belt 74 is higher than the temperature of the fixing roller 73, the heat energy moves from the fixing belt 74 to the fixing roller 73. In a case where the temperature of the fixing belt 74 is lower than the temperature of the fixing roller 73, the heat energy moves from the fixing roller 73 to the fixing belt 74. The case where the temperature of the fixing belt 74 is higher than the temperature of the fixing roller 73 will be described here.

A dashed-two dotted line X in FIG. 7B shows a relationship between the temperature of the fixing heater 71 and the surface temperature of the fixing belt 74 in a case where the temperature of the fixing roller 73 is sufficiently high. A dashed-two dotted line Y shows a relationship between the temperature of the fixing heater 71 and the surface temperature of the fixing belt 74 in a case where the temperature of the fixing roller 73 is extremely low. That is, in the case where the temperature of the fixing roller 73 is low, the temperature of the fixing belt 74 more greatly decreases than in the case where the temperature of the fixing roller 73 is high, and the change of the temperature of the fixing roller 73 exactly becomes the change of the temperature the fixing belt 74 at position N at which the fixing belt 74 and the fixing roller 73 are in contact with each other. Thus, even if the temperature of the fixing heater 71 is controlled to be constant according to the conventional technology, the change of the temperature of the fixing roller 73 greatly changes the nip portion temperature and changes the heat energy given to the medium 8, thus deteriorating the printing quality. In this embodiment, the target temperature of the fixing heater 71 is obtained from the relationship as shown in FIG. 8. Thus, the printer according to this embodiment can suppress the change of the nip portion temperature even in a case where the temperature of the fixing roller 73 greatly changes, and the heat can be stably supplied to the medium 8.

FIG. 8 is a figure describing the calculation method of the target temperature of the fixing heater 71 based on a relationship of temperatures at position H to position N. A case is considered where Tb in FIG. 8 is an ideal temperature of the fixing belt 74 at position N under the current printing conditions. At this moment, in a case where the temperature of the fixing roller 73 is high, a relationship between the temperature Th of the fixing heater 71 and the temperature Tbelt of the fixing belt 74 is denoted by the dashed-two dotted line X in FIG. 8. At this moment, the target temperature of the fixing heater 71 is set to the temperature T_low based on the dashed-two dotted line X. Similarly, in the case where the temperature of the fixing roller 73 is low, the dashed-two dotted line Y in FIG. 8 shows a relationship between the temperature Th of the fixing heater 71 and the temperature Tbelt of the fixing belt 74. Accordingly, the target temperature of the fixing heater 71 at this moment is set to the temperature T_high.

The above-described relationship of the temperatures between the fixing heater 71, the fixing roller 73, and the fixing belt 74 is represented by Formula 1 and Formula 2 as described above. The print control unit 1 uses Formula 1 to calculate the nip portion temperature at position N from the heater temperature of the fixing heater 71 detected by the heater thermistor 72 and the temperature of the fixing roller 73 detected by the fixing thermistor 76 periodically at an interval of, for example, 1 s to 100 ms. Next, the print control unit 1 uses Formula 2 to calculate the target temperature of the fixing heater 71 so that the nip portion temperature becomes the target temperature of the nip portion. Subsequently, the print control unit causes the fixing heater control unit 16 to control the heating of the fixing heater 71 to suppress the change of the temperature in the nip portion.

It should be noted that in a case where the temperature of the fixing roller 73 is extremely low, there may be a case where the heat of the fixing heater 71 may become extremely high. In normal operation environment, this kind of abnormal heating and the like of the fixing heater 71 does not occur. But there may be a case, for example, where the temperature of the fixing roller 73 is not correctly detected and is detected as an extremely lower temperature than an actual temperature due to a contact failure of the fixing thermistor 76 and a defect of the element itself. In a case where such abnormality occurs, the abnormal heating of the fixing heater 71 may seriously affect the fixing heater 71 itself or the fixing belt 74, and may eventually affect the fixing device 7. At worst, there is a possibility that the abnormal heating may cause smoke, fire, and the like. Thus, the print control unit 1 controls the target temperature of the fixing heater 71 to make the temperature of the fixing belt 74 lower than a temperature at which other portions are damaged.

Figure 9A:
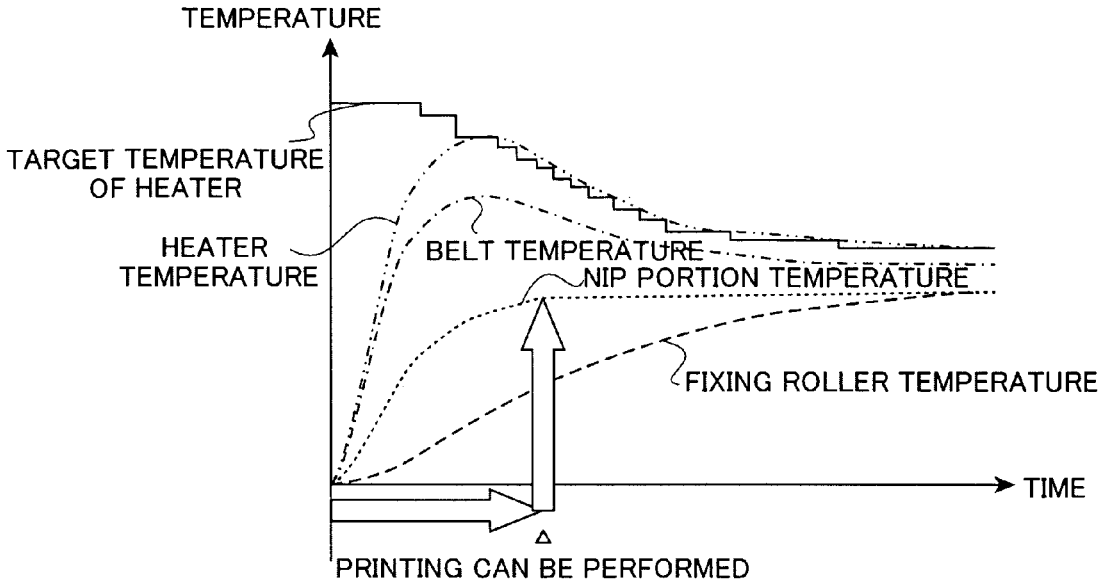
FIGS. 9A and 9B are figures describing the change of temperatures of a fixing heater, a fixing belt, a nip portion, and a fixing roller in a case where the fixing heater is controlled through the temperature control operation according to the first embodiment and in a case where the fixing heater is controlled through the temperature control operation of a conventional art.
Figure 9B:
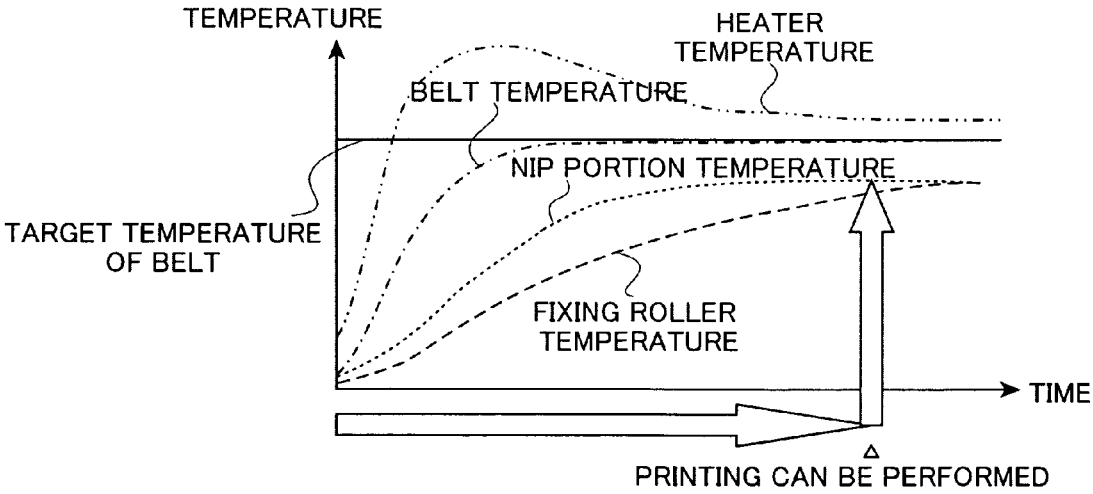

FIGS. 9A and 9B show the change of the temperatures of the fixing heater, the fixing belt, the nip portion, and the fixing roller in a case where the fixing heater is controlled according to the temperature control operation of this embodiment and in a case where the fixing heater is controlled according to the temperature control operation of the conventional technology. It should be noted that the solid line denotes the target temperature of the fixing heater, that the dashed-two dotted line denotes the fixing heater temperature, the dashed dotted line denotes the surface temperature of the fixing belt at a position (position H) at which the fixing belt is in contact with the fixing heater, that the dotted line denotes the nip portion temperature, and that the broken line denotes the fixing roller temperature.

In the temperature control operation according to the conventional technology (FIG. 9B), the fixing heater is controlled so that the surface temperature of the fixing belt becomes constant, and accordingly, the nip portion temperature becomes low in a condition where the temperature of the fixing roller is low. Thus, in a case where the printing operation is configured to wait until the temperature of the fixing roller sufficiently increases, it takes a lot of time to start the printing operation because the thermal capacity of the fixing roller is large.

On the other hand, in the temperature control operation according to this embodiment (FIG. 9A), the print control unit controls the fixing heater upon calculating the target temperature of the fixing heater so that the nip portion temperature reaches a predetermined temperature. Thus, even in a condition where the temperature of the fixing roller is low, the print control unit can control the fixing heater so that the nip portion temperature reaches an appropriate temperature in a shorter time. As a result, the printing operation can be started in a shorter time.

According to the first embodiment, the print control unit 1 controls the target temperature of the fixing heater 71 according to the temperature of the fixing roller 73 detected by the fixing thermistor 76. Thus, even if the temperature of the fixing roller 73 changes, the change of the nip portion temperature can be suppressed, the heat energy can be stably supplied to the medium 8, and the deterioration of the printing quality can be prevented.

Second Embodiment

In the second embodiment, a correlative relationship between a moving ratio of the heat energy and a printing speed is obtained through experiment. Configuration values set through experiment are selected according to the speed set by the printing speed setting unit. An ideal fixing heater temperature is calculated using the selected configuration value. Thus, the second embodiment provides a printer capable of controlling the change in the nip portion temperature even where the printing speed is fast.

Figure 10A:
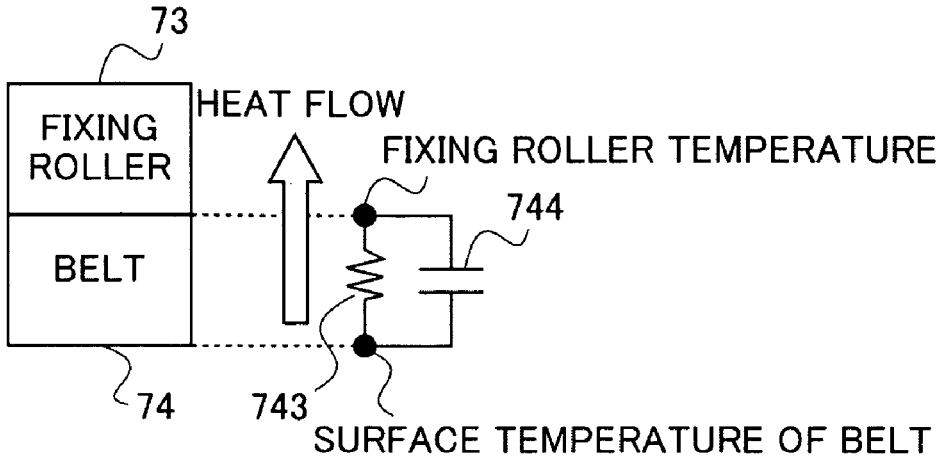
FIGS. 10A and 10B are figures describing the calculation method of the target value in a case of fast printing.
Figure 10B:
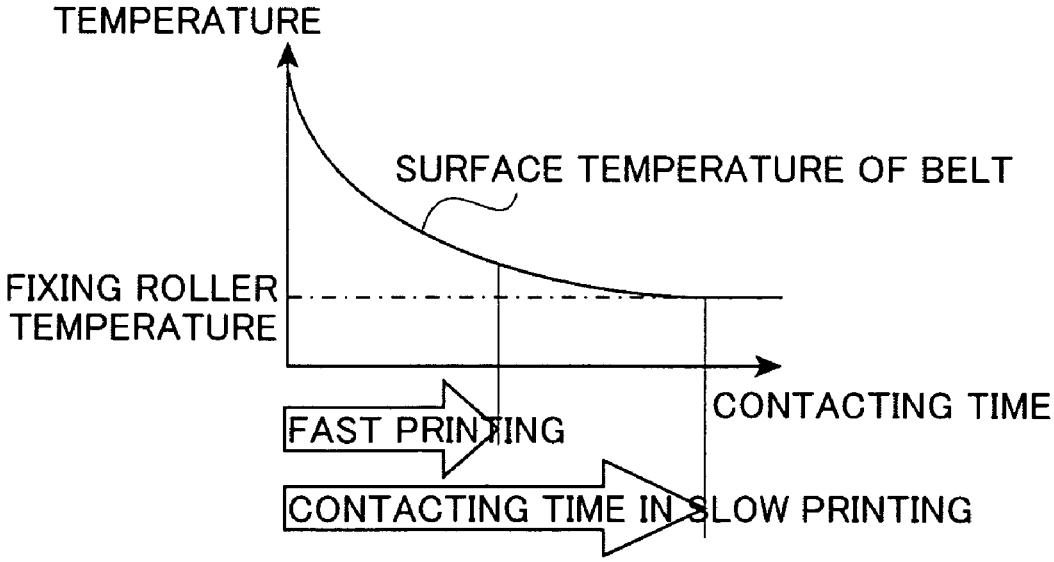

First, a calculation method of the target value in a case where the printing speed is fast will be hereinafter described with reference to FIGS. 10A and 10B. FIG. 10A is a schematic diagram describing a thermal equivalent circuit between the fixing belt 74 and the fixing roller 73. In the heat equivalent circuit, the heat resistance-743 and the thermal capacity 744 are connected in parallel between the surface temperature of the fixing belt 74 and the surface temperature of the fixing roller 73. The thermal capacity 744 is a heat quantity (unit weight) required for increasing the temperature of a member (the fixing belt 74 in this embodiment) for one unit temperature (for example 1 degrees Celsius). That is, it is necessary to apply a certain heat energy to the fixing belt 74 to increase the temperature of the fixing belt 74. Furthermore, there exists the heat resistance 743 between the surface of the fixing belt 74 and the surface of the fixing roller 73. The heat resistance 743 expresses the degree of difficulty in moving the heat energy between the surface of the fixing belt 74 and the surface of the fixing roller 73. That is, in a case where the heat resistance is large, the heat energy has difficulty in moving through the material, which means that the difference of the temperature between the surface of the fixing belt 74 and the surface of the fixing roller 73 becomes large.

The change of the temperature in a miniscule time when the heat energy is transmitted will be hereinafter considered. FIG. 10B is a figure describing how the temperature changes after the fixing belt 74 and the fixing roller 73 comes in contact with each other. FIG. 10B shows a time-change (with respect to a contacting time) of the surface temperature of the fixing belt 74 when the fixing belt 74 is in contact with the fixing roller 73 at the nip portion in a case where the temperature of the fixing belt 74 is larger than the temperature of the fixing roller 73. As described above, a time (thermal time constant) determined by the heat resistance 743 and the thermal capacity 744 is needed in order to make the temperature of the fixing belt 74 be substantially stable (equilibrium), namely, to make the temperature of the fixing belt 74 be the same as the temperature of the fixing roller 73. This is because it is necessary to apply a certain heat quantity and it is also necessary to complete the transmission of the applied heat energy to make the temperature be equilibrium, and accordingly, a finite time (thermal time constant) is needed to complete the transmission of the heat energy because the heat resistance Rd743 hinders the move of the heat energy. The fixing belt 74 has the thermal capacity although it is small, and the time corresponding to the thermal time constant is needed to achieve the heat equilibrium.

In a case where the printing speed is slow, the contacting time between the fixing belt 74 and the fixing roller 73 is long enough relative to the thermal time constant of the fixing belt 74, and the move of the heat energy from the fixing belt 74 to the fixing roller 73 is completed. Thus, the relationship between the surface temperature of the fixing belt 74 and the temperature of the fixing roller 73 becomes constant. In a case where the printing speed is fast, the contacting time between the fixing belt 74 and the fixing roller 73 becomes short relative to the thermal time constant of the fixing belt 74. As a result, the move of the heat energy from the fixing belt 74 to the fixing roller 73 is not completed, and an error occurs in the calculation of the relationship between the temperature of the fixing belt 74 and the temperature of the fixing roller 73, so that the surface temperature of the fixing belt 74 becomes always higher than the fixing roller 73. Thus, it is necessary to correct the target temperature of the fixing heater 71 according to the printing speed.

Figure 11:
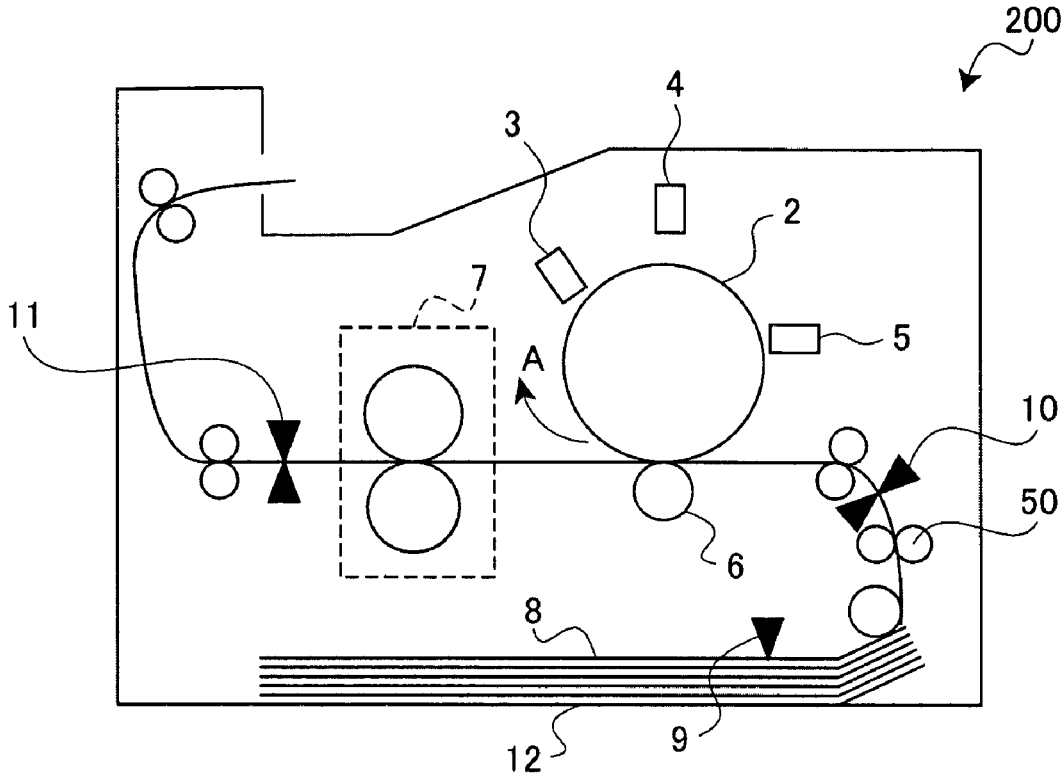
FIG. 11 is a figure describing the structure of a printer according to the second embodiment.
Figure 12:
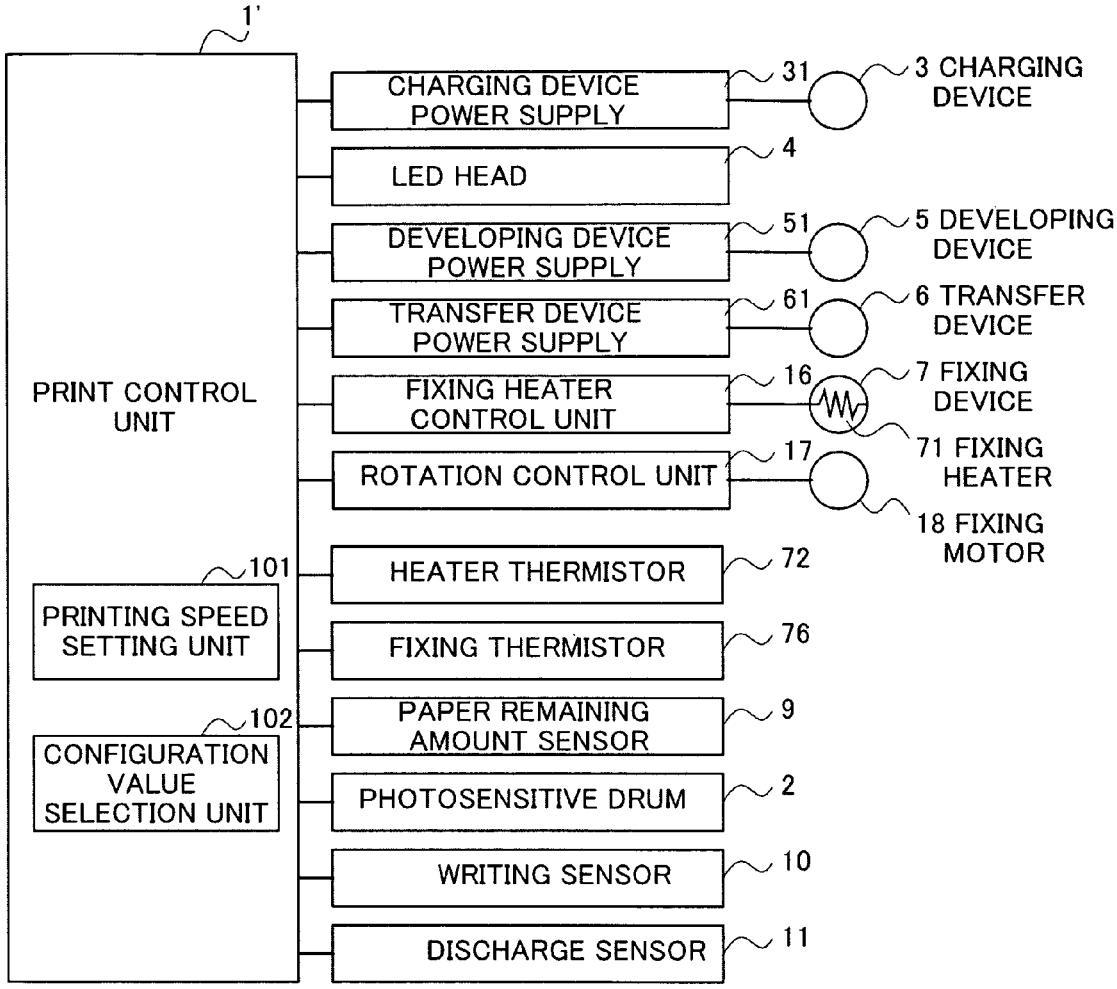
FIG. 12 is a figure describing the structure of an essential portion of the printer controlled by a print control unit.

The configuration of an essential portion of a printer 200 according to the second embodiment and the configuration of an essential portion controlled by a print control unit 1' are substantially the same as the printer 1 according to the first embodiment and the print control unit 1 (FIG. 11). But in addition to the first embodiment, the print control unit 1' has a printing speed setting unit 101 and a configuration value selection unit 102 in which coefficients used for a calculation of Formula 3 described later is previously determined and registered for each printing speed (FIG. 12).

Figure 13:
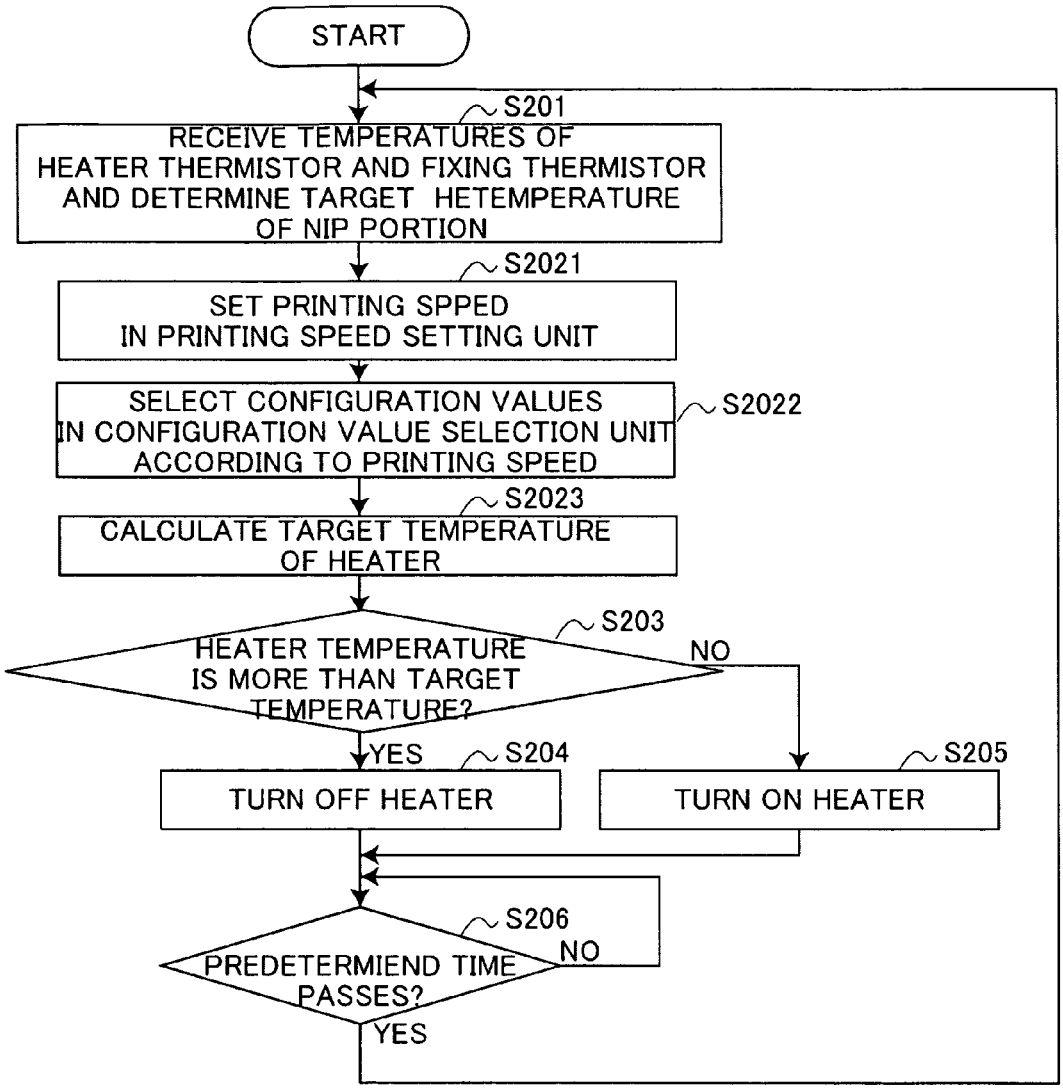
FIG. 13 is a flowchart describing the temperature control operation performed by the printer.

FIG. 13 is a flowchart describing the temperature control operation of the printer 200. The processings of S201 and 5203 to S206 performed by the print control unit 1' are substantially the same as the operation of the print control unit 1 according to the first embodiment, and the description thereabout is omitted. At S2021, the print control unit 1' sets the printing speed according to information of the printing condition supplied from the host controller, not shown. In a case where the host controller, not shown, selects, for example, thick paper, OHP sheet, and the like as the printing medium, the print control unit 1' sets the printing speed slower than the printing speed for ordinary standard paper, and this information is registered in the printing speed setting unit 101.

Next, the print control unit 1' selects (S2022) coefficients used in Formula 3 described later, namely, configuration values D, E, and F registered in the configuration value selection unit 102 based on the printing speed set at S2021. The configuration value is set for each printing speed to correct calculation errors occurring in a case where the printing speed is made to be especially fast, and is set for each configuration value of the first embodiment calculated from the relationship of the thermal resistances between the fixing heater, the fixing belt, the nip portion, and the fixing roller. The configuration values are calculated through experiment, and are determined based on the time of moving the heater energy and the printing speed (the contacting time between the fixing belt 74 and the fixing roller 73).

The print control unit 1' calculates (S2023) the target temperature of the fixing heater 71 using Formula 3 with the configuration values D, E, and F selected in S2022.

$$Theat(s)=D*Thip(t)-E*Troll(m)+F \quad \text{(Formula 3)}$$

Theat(s) is the target temperature of the fixing heater 71, and Thip(t) is the target temperature of the nip portion. D, E, and F are the configuration values (obtained through experiment) calculated from the heat resistances between the members. The calculation method using Formula 3 is the same as the first embodiment. The difference from the first embodiment is that each coefficient for calculating the target temperature is different according to the printing speed.

After the target temperature of the fixing heater 71 is calculated in S2023, the print control unit 1' performs processings in S203 to S206 that are similar to the processings of S103 to S106 of the first embodiment. The print control unit 1' uses the corrected configuration values that are not influenced by the time of moving the heat energy and the contacting time (the contacting time between the fixing belt 74 and the fixing roller 73). As a result, the target temperature of the fixing heater 71 can be optimized even where the printing speed is made to be fast, and thus, the change of the temperature in the nip portion can be suppressed.

Figure 14:
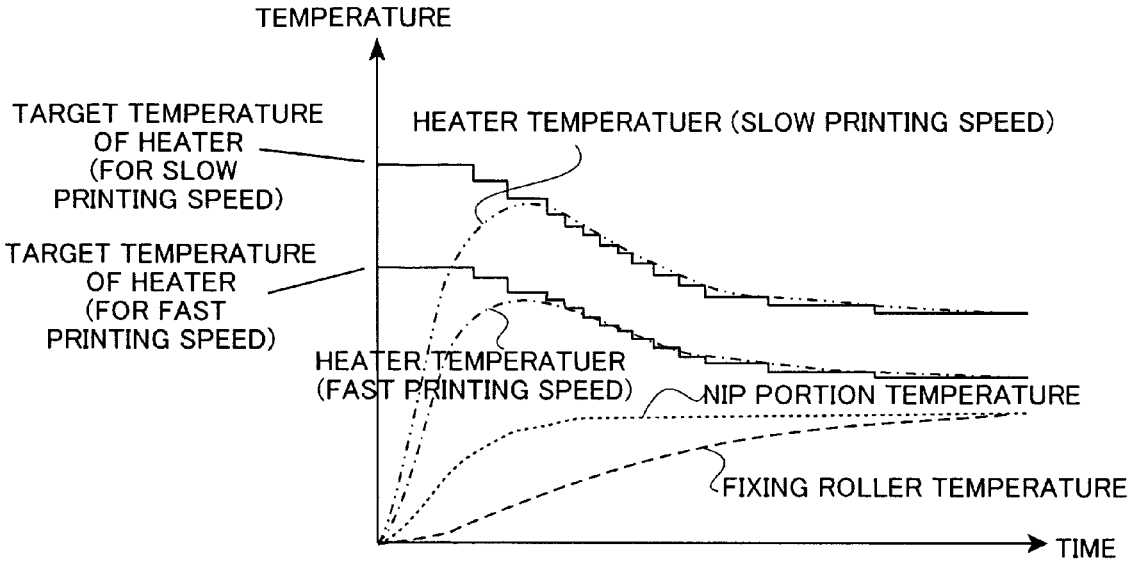
FIG. 14 is a figure describing the change of temperatures of the fixing heater, the fixing belt, the nip portion, and the fixing roller in a case where the fixing heater is controlled through the temperature control operation according to the second embodiment.

FIG. 14 is a figure showing the change of the temperature of the fixing heater 71, the fixing belt 74, the nip portion 79, and the fixing roller 73 in a case where the fixing heater 71 is controlled through the temperature control operation according to this embodiment. The solid lines denote the target temperatures of the fixing heater 71 at the slow printing and at the fast printing, the dashed-two dotted line denotes the change of the temperature of the fixing heater 71 at the slow printing, the dashed dotted line denotes the change of the temperature of the fixing heater 71 at the fast printing, the dotted line denotes the nip portion temperature, and the broken line denotes the temperature of the fixing roller 73.

As shown in FIG. 14, the target temperature of the fixing heater 71 is set to a high temperature in the case of the slow printing, and the target temperature of the fixing heater 71 is set to a low temperature in the case of the fast printing. In the case of the fast printing, the temperature of the fixing belt 74 becomes higher than in the case of the slow printing. Thus, in the case of the fast printing, the target temperature of the fixing heater 71 is set to a low temperature, so that the change of the nip portion temperature is suppressed as shown in FIG. 14. Thus, the printing can be performed without deteriorating the printing quality even where the printing is made to be faster.

The print control unit 1' according to the second embodiment has the printing speed setting unit 101 and the configuration value selection unit 102 in addition to the configuration of the print control unit 1 according to the first embodiment. The print control unit 1' chooses the configuration values according to the printing speed in consideration of the time of moving the heat and the contacting time between the fixing belt 74 and the fixing roller 73, and uses Formula 3 to set the appropriate temperature of the fixing heater 71. Thus, the printer according to the second embodiment can suppress the change in the nip portion temperature regardless of the printing speed, and can prevent deterioration of the printing quality due to the change of the printing speed.

Although the preferred embodiments are described above, this invention is not limited to the embodiments as described above. The structure and the configuration of the embodiments can be arbitrarily changed as long as the embodiments does not deviate from the gist of this invention. For example, this invention can be applied to an MFP (Multifunction Peripheral), a facsimile machine, a copier, and the like.

The foregoing description of preferred embodiments of the invention has been presented for purposes of illustration and description, and is not intended to be exhaustive or to limit the invention to the precise form disclosed. The description was selected to best explain the methods of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. An image forming apparatus comprising:

a first pressurizing member;

a heating member;

a belt member laid across the heating member and the first pressurizing member in a tensioned state, the belt member being heated by the heating member;

a second pressurizing member arranged at such a position that the second pressurizing member is pressed against the first pressurizing member via the belt member;

a heating control unit for controlling heating of the heating member to drive a temperature of the heating member toward a target temperature; and a first temperature detection unit for detecting a temperature of the first pressurizing member;

wherein a developer image on a medium between the belt member and the second pressurizing member is fixed, and wherein the heating control unit determines the target temperature based on the temperature of the first pressurizing member detected by the first temperature detection unit.

2. The image forming apparatus according to claim 1, further comprising:

a second temperature detection unit for detecting a temperature of the heating member;

wherein the heating control unit controls heating of the heating member to drive the temperature of the heating member detected by the second temperature detection unit toward the target temperature.

3. The image forming apparatus according to claim 2, wherein the second temperature detection unit is arranged on an inner side of the belt member and is arranged in contact with the heating member.

4. The image forming apparatus according to claim 1, further comprising:

a printing speed setting unit for setting a printing speed; and a configuration value selection unit for storing a plurality of configuration values, for selecting one of the plurality of configuration values according to the printing speed, and for calculating the target temperature using the selected configuration value.

5. The image forming apparatus according to claim 4, wherein the faster the printing speed is, the lower the target temperature of the heating member is set to.

6. The image forming apparatus according to claim 1, wherein the heating member is arranged upstream, with respect to a medium conveyance direction, of a nip portion at which the medium is in contact with the second pressurizing member.

7. The image forming apparatus according to claim 1, wherein the first temperature detection unit is arranged on an inner side of the belt member and is arranged within a medium conveyance area.

8. The image forming apparatus according to claim 7, wherein the first temperature detection unit is arranged to be in contact with the first pressurizing member.

9. The image forming apparatus according to claim 1, wherein the lower the detected temperature of the first pressuring member is, the higher the target temperature of the heating member is set to.

10. The image forming apparatus according to claim 1, wherein the heating member is a sheet heater arranged to be in contact on the inner surface of the belt member.

11. The image forming apparatus according to claim 1, wherein a thermal capacity of a material of the first pressurizing member is larger than a thermal capacity of a material of the belt member.

12. The image forming apparatus according to claim 1, wherein the target temperature of the heating member is determined periodically at a predetermined interval.

* * * * *